US006439707B1

(12) United States Patent
Deshmukh

(10) Patent No.: US 6,439,707 B1
(45) Date of Patent: Aug. 27, 2002

(54) ANTI-SPILL FLUID FILLING PORT

(75) Inventor: Govind Sanjeevanrao Deshmukh, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/770,347

(22) Filed: Jan. 25, 2001

(51) Int. Cl.[7] ..... B41J 2/175
(52) U.S. Cl. ..... 347/86; 347/85
(58) Field of Search ..... 347/85, 86, 87, 347/84; 141/251, 258, 263, 284; 222/206, 212, 213, 214

(56) References Cited

U.S. PATENT DOCUMENTS 5,409,144 A * 4/1995 Brown ..... 222/185
5,706,870 A * 1/1998 Maerzke ..... 141/18
5,758,802 A * 6/1998 Wallays ..... 222/212
5,886,719 A * 3/1999 Zepeda ..... 347/85
5,946,014 A * 8/1999 Shimomura et al. ..... 347/87
5,949,461 A * 9/1999 Jones et al. ..... 347/87
6,130,696 A * 10/2000 Mashita et al. ..... 347/86
6,199,725 B1 * 3/2001 Garibaldi ..... 222/207

* cited by examiner

*Primary Examiner*—Michael Nghiem

(57) ABSTRACT

The anti-spill, fluid filling port has an upper section that is molded into the soft plastic wall of the fluid holding device. The bottom of the upper section is capped with a semi-spherical section that comes to an apex in the middle. The semi-spherical section is formed by six triangular-shaped sections that meet at the apex. As the fluid filling needle is inserted into the port, the triangular shaped sections separate wide enough to allow the circumference of the needle to be inserted but remain in contact with the needle. As the fluid filling needle is removed, the triangular shaped sections wipe off excess fluid from the outside of the needle and then close when the needle is completely withdrawn, thus retaining the fluid within the device.

15 Claims, 9 Drawing Sheets

- PRIOR ART -

ANTI-SPILL FLUID FILLING PORT

TECHNICAL FIELD

The present invention relates generally to anti-spill ports for fluids. More particularly, the present invention relates to the transference of fluids through the anti-spill port into a fluid holding device.

BACKGROUND OF THE INVENTION

FIG. 1 illustrates a typical prior art thermal inkjet pen. This inkjet pen includes a main unitary body housing (101) of a suitable non-hygroscopic plastic material for outer chambers and a soft plastic (105) inner frame that is favorable for bag film staking. The inner frame of the housing (105) contains a staked aluminized polyethylene film bag (110) for storing the ink. There is also a stainless steel spring (130) inside the bag that is submerged in the ink to provide the necessary capillary backpressure at the print head of the pen to prevent ink from dripping out of the pen.

The pen further includes an output or print head support section (140) that has a small output opening (145) adjacent to which is mounted a thin film thermal inkjet print head (120). The print head support section (140) has interior walls that define the contour of a large diameter standpipe and an air accumulating section.

As seen in FIG. 1, the air accumulating section (145) of the standpipe is the upper portion thereof just beneath the wire mesh filter (115). Air accumulates in this section (145) when the pen is operating in the orientation shown in FIG. 1. As a result of the wire mesh filter (115), air bubbles entering the standpipe from the print head are trapped. The filter (115) prevents any trapped air in the ink filled bag (110) from being drawn down into the standpipe.

The thermal inkjet pen also typically includes an electrical connection (150). The electrical connection (150) provides the ability for signals from the inkjet printer in which the pen is place to communicate with the inkjet pen. The electrical connection (150) is comprised of a plurality of electrical contacts that enable the printer's controller to address each of the heating elements in the print head (120).

After such an inkjet pen in manufactured, it must move down a line to be filled with ink. To accomplish this, the inkjet pen moves to an ink-filling station, a needle is inserted into the ink filling port (125) in the inkjet pen, and ink is injected through the needle into the body of the pen. After a predetermined quantity of ink has been injected into the inkjet pen, the needle is withdrawn from the pen, the filled pen is moved down the line to the next station where a stainless steel ball cork is inserted into the fill hole to keep the ink in the inkjet pen body. Additionally, a Pet plastic coated plastic film patch (160) is staked on the exterior to completely seal the ink fill port. This patch has the same diameter as the soft plastic that is exposed. This inkjet pen has a lever (135) to ease installation and removal of the pen from the inkjet printer carriage.

A typical prior art ink filling port is illustrated in FIG. 12. This port is comprised of a through hole (1201) in the soft plastic inner frame (1205) of the inkjet pen. An internal ridge or detent (1210) keeps the ball cork in position and provides a primary seal.

One potential problem is that as the needle is withdrawn from the inkjet pen, the needle may still have ink on its outer surface. The ink may be transferred onto the ink fill mechanism and, if it has corrosive characteristics, it may cause the needle housing to become gummy and require frequent cleaning to prevent its decay over a period of time. Frequent cleaning cycles would also cause loss of productivity. Additionally, as the pen moves, the ink may spill out of the fill hole and cover the machinery used to convey the inkjet pen. This could eventually require that the line be shut down to clean up spilled ink in order to prevent corrosion of the line equipment. Also, the ball cork may slip down into the inkjet pen, thus causing the pen to be removed from the line and money lost as a result. There is a resulting unforeseen need for an improved product that prevents ink from spilling out and at the same time wipes the needle on its return stroke.

SUMMARY OF THE INVENTION

The present invention encompasses an anti-spill filling port for a fluid. The preferred embodiment of the anti-spill filling port is for use in an inkjet pen.

The filling port is part of the inner frame of the pen body that is molded from soft plastic and has an interlock with the outer hard plastic frame. The invention embodies six "petals" that are molded in a semispherical form and congregate at the center of the fill port. Each petal is connected to the other by a thin plastic diaphragm that acts as a spill inhibiter. When punctured by the fluid fill needle, the thin diaphragm tears only up to the radius of the needle leaving the rest still connected to each other to act as a wiper. The memory effect of the membranes returns the petals to close in after the needle is retracted. The upper portion of each petal acts as hinge when the needle is inserted.

DETAILED DESCRIPTION OF THE PREFERRED EMBODIMENT

The anti-spill filling port of the present invention prevents a fluid from spilling out of a fluid dispensing device while it is moving on an assembly line. The anti-spill filling port provides the additional benefit of wiping any fluid remaining on the fluid fill needle as it is being extracted from the device after filling and gives firmer support to a ball cork that, in the prior art, had a tendency to fall inside the fluid chamber during the cork insertion. This caused yield loss and line down time due to spillage.

The present invention is subsequently described referring to the preferred embodiment use of the anti-spill filling port in an inkjet pen. The preferred embodiment fluid is ink while the fluid dispensing device is an inkjet pen. This invention is not limited in any way to the preferred embodiment. Types of fluids other than ink are encompassed by the present invention. Additionally, the anti-spill filling port can be used in fluid dispensing devices other than inkjet pens. For example, in one embodiment, the fluid is medicine and the fluid dispensing device is a medicine dispenser.

Figure 1:
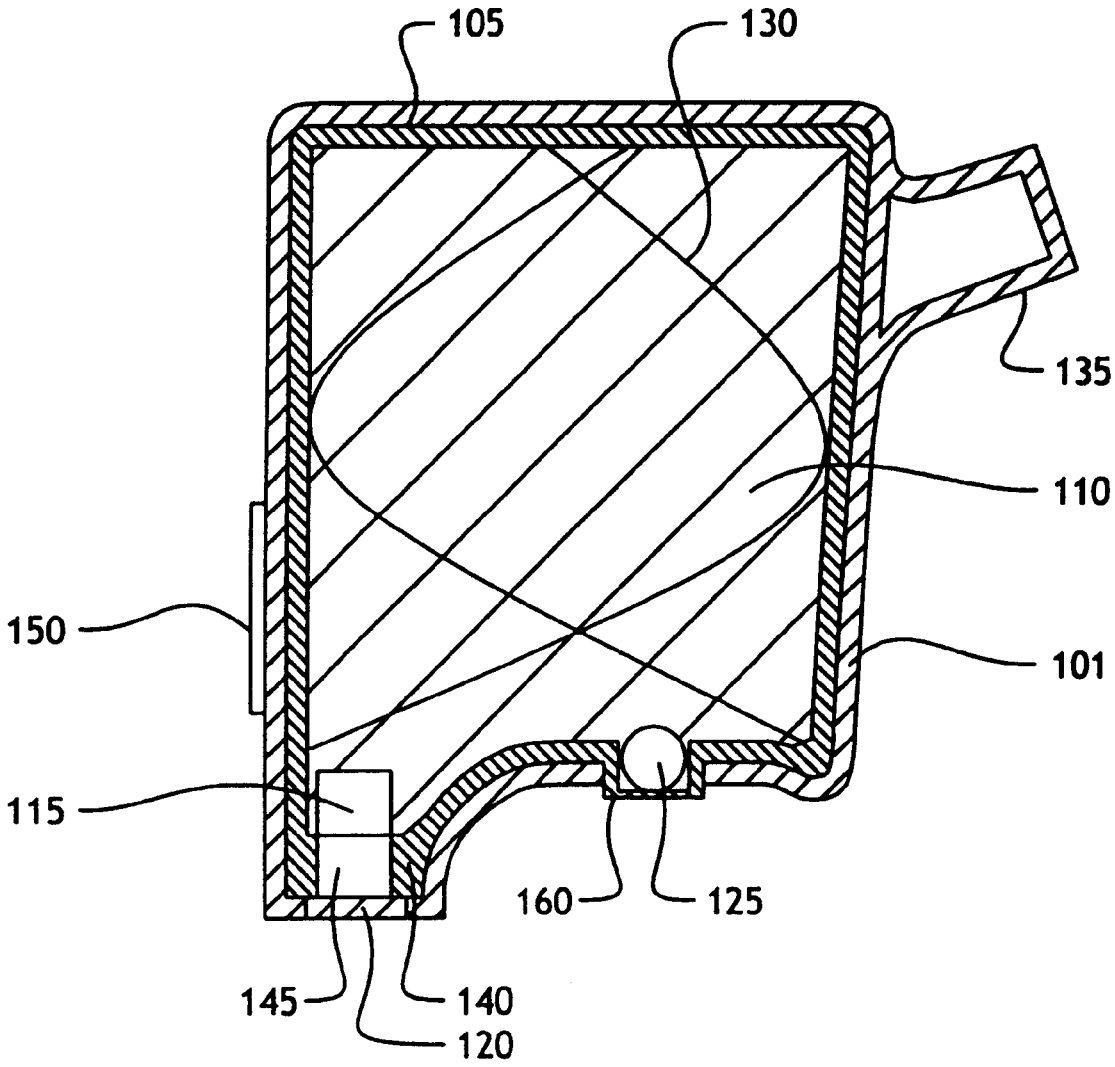
(PRIOR ART) Fig. 1
FIG. 1 shows a typical prior art thermal inkjet pen.
Figure 2:
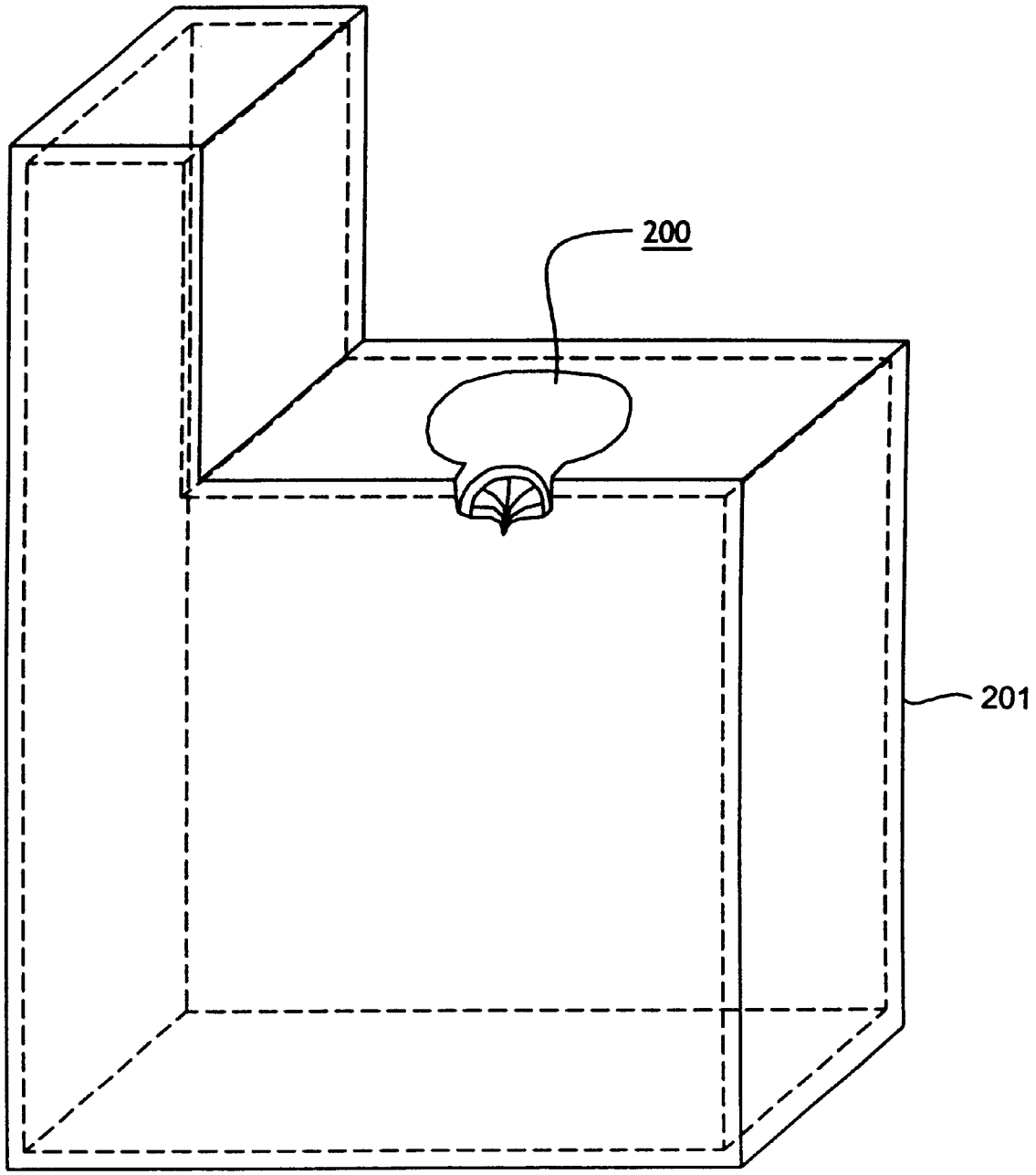
FIG. 2 shows a thermal inkjet pen incorporating the anti-spill filling port of the present invention.

FIG. 2 illustrates a thermal inkjet pen (201) incorporating the anti-spill ink filling port (200) of the present invention. In the preferred embodiment, this port is located on the top of the inkjet pen as it moves through the assembly line for filling of the pen with ink. Alternate embodiments locate the port on other sides of the inkjet pen.

Figure 13:
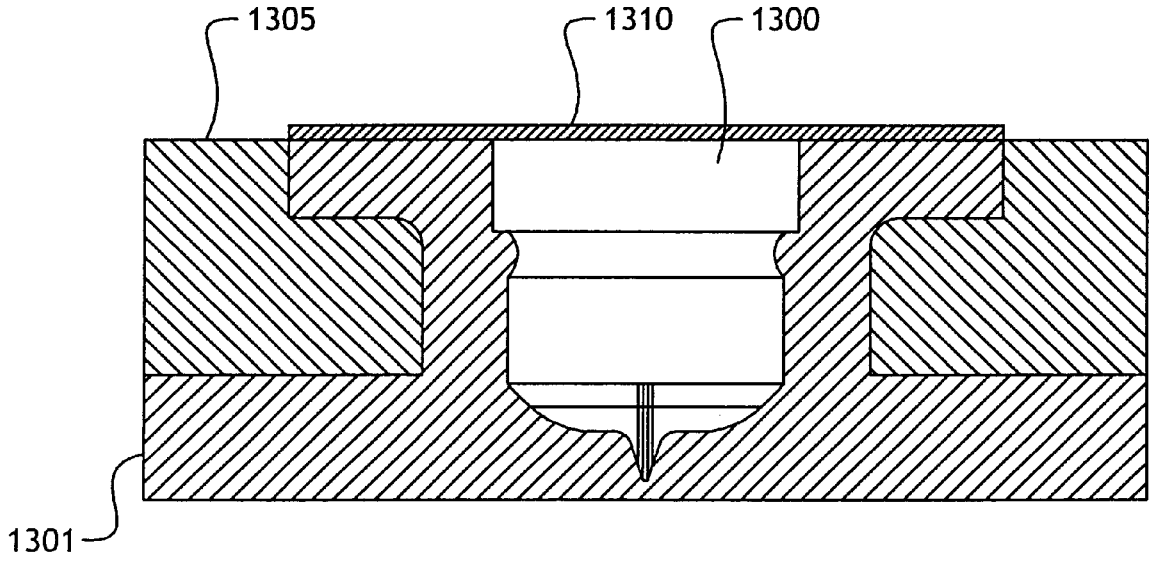
FIG. 13 shows a cross sectional view of the anti-spill filling port of the present invention.

In the preferred embodiment, as illustrated in FIG. 13, the ink filling port (1300) of the present invention is molded into the soft plastic (1301) that lines the inner portions of the inkjet pen frame (1305). For purposes of clarity, the figures of the present invention illustrate the ink filling port as being separate from the rest of the soft plastic liner. In an alternate embodiment, the ink filling port is molded separately from the inner soft plastic liner and inserted into the filler hole of the hard plastic frame.

Also for clarity purposes, the Pet plastic coated plastic film patch (1310) that is staked on the exterior to completely seal the ink fill port (1300) is shown in FIG. 13 only. This patch (1310) has the same diameter as the soft plastic (1301) that is exposed and is installed after the ball cork, described subsequently, is installed.

Figure 3:
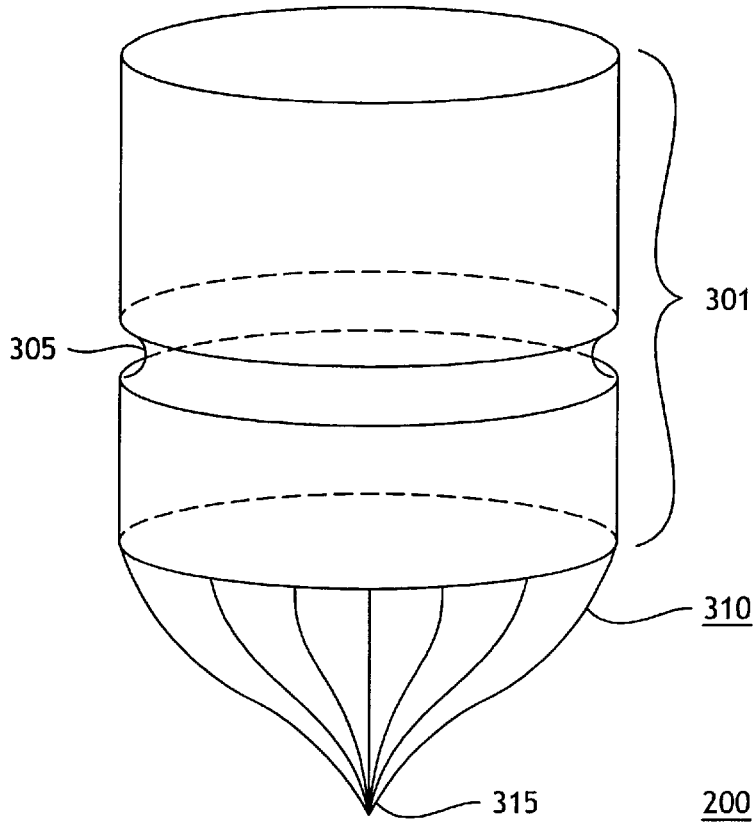
FIG. 3 shows a three dimensional view of the anti-spill filling port of the present invention as it appears when removed from an inkjet pen.

FIG. 3 illustrates the anti-spill ink filling port as it appears removed from the inkjet pen. In the preferred embodiment, the ink filling port is comprised of a soft plastic material that is pliable enough to bend and not shatter when pushed by an ink filling needle. Alternate embodiments use other types of materials to manufacture the anti-spill ink filling port.

The port is comprised of a cylindrical upper section (301) that. In the preferred embodiment, the upper section (301) is the same length as the thickness of the pen's soft plastic liner. Alternate embodiments extend the molded port beyond the thickness of the inner liner.

The cylindrical section (301) is comprised of a ridge (305) that encircles and extends into the cylindrical section (301). As will be seen later, the ridge (305) holds in the sealing ball cork.

The preferred embodiment uses a cylindrical section (301). Alternate embodiments use other shapes for this section such as a square shape, a rectangle shape, and any other shape that can be molded into plastic and also accept the ink filling needle.

In the preferred embodiment, the ridge (305) extends around the complete circumference of the cylindrical section (301). In an alternate embodiment, the ridge (305) only extends partially around the circumference. In yet another embodiment, the ridge (305) is broken up into multiple sections.

The bottom of the cylindrical section (301) is coupled to a domed or semi-spherically-shaped section (310) that covers the entire end of the cylindrical section (301). In the preferred embodiment, the dome-shaped section (310) is comprised of an apex (315) in the center of the dome (310). In an alternate embodiment, the dome-shaped section does not have the apex.

The preferred embodiment of the bottom of the cylindrical section is semispherical in shape. In alternate embodiment, this section has a pyramid or conical shape instead of a dome shape.

Figure 4:
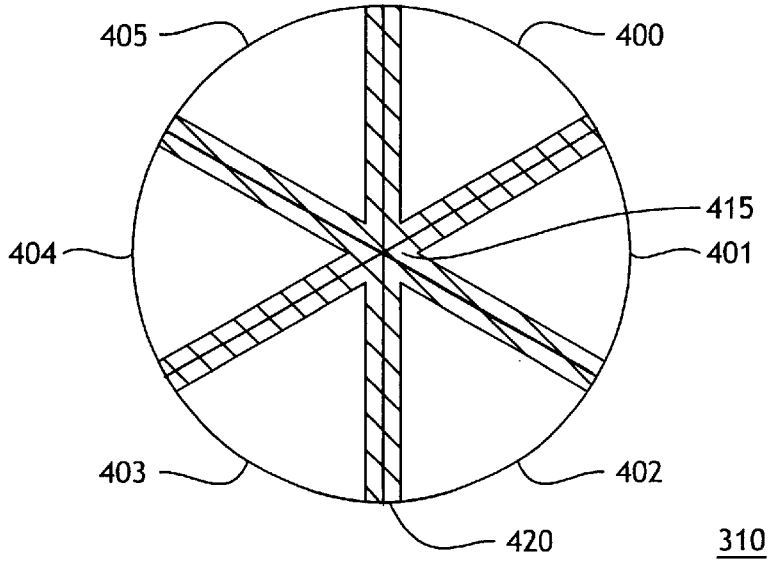
FIG. 4 shows an end view of the anti-spill filling port of the present invention.

As illustrated in FIG. 4, the dome-shaped section (310) of the ink filling port is comprised of multiple triangle-shaped sections (400–405) that are adjacent to each other and come to a point at the apex (415) of the dome (310). The long sides of each of the triangle-shaped sections (400–405) are grooved (420) in order to ensure a better fit when the fill needle has been withdrawn and the sections (400–405) have returned back to their closed position.

The grooves (420) along the sides of the triangle-shaped sections (400–405) are thinner than the rest of the triangle-shaped sections (400–405). Therefore, when an ink filling needle is inserted, the thinner plastic breaks to allow the sections (400–405) to move about their hinge side coupling the sections to the upper section (301). An alternate embodiment simply scores the adjacent sides to allow for easier breaking of the plastic to allow needle insertion.

In the preferred embodiment, there are six sections (400–405) each forming a 60° arc of the circular dome-shaped section (310). Alternate embodiments use other quantities of sections to perform substantially the same function.

Figure 5:
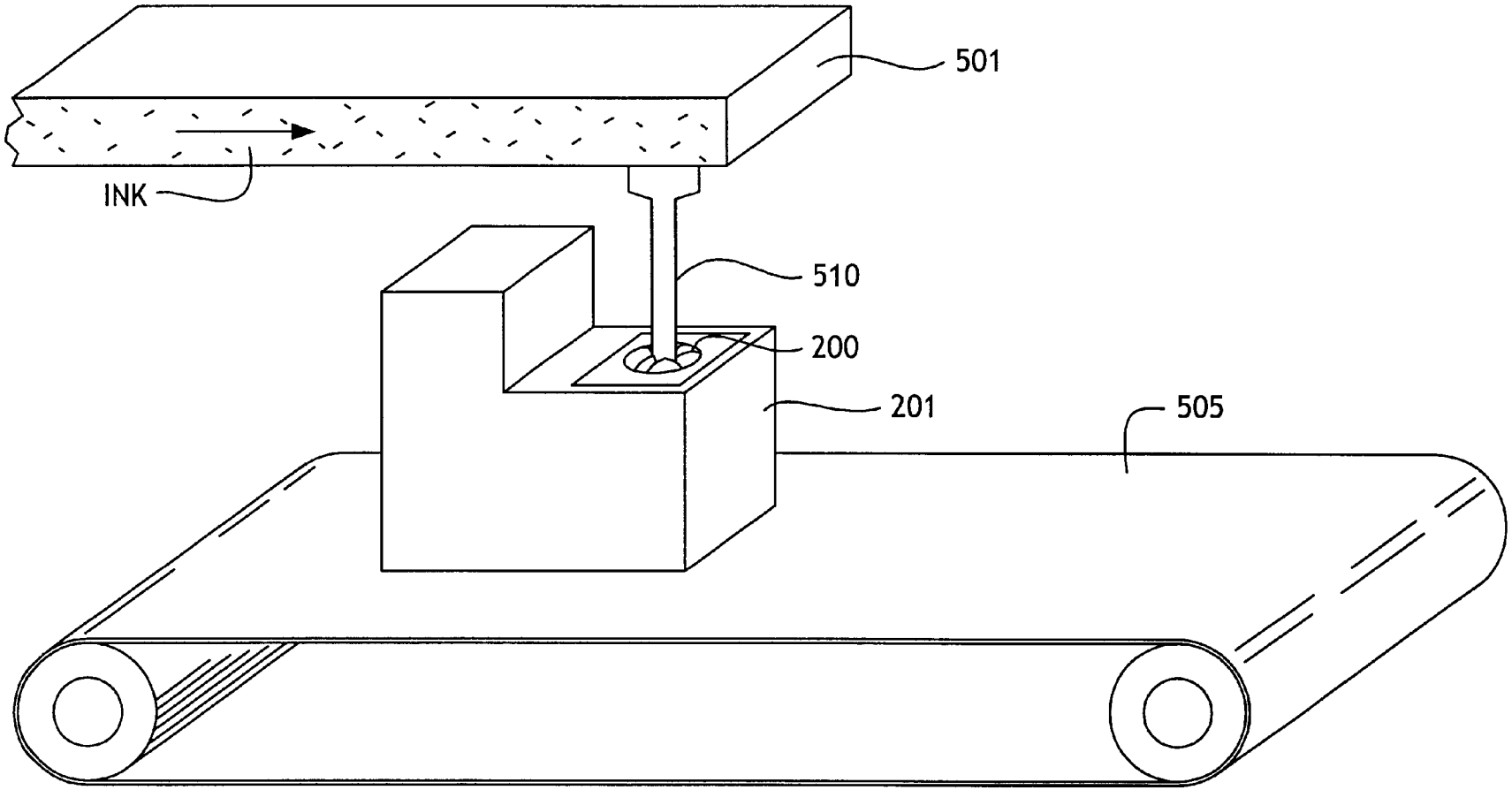
FIG. 5 shows a fluid filling operation in accordance with the anti-spill filling port of the present invention.

FIG. 5 illustrates an assembly line filling operation for the inkjet pen incorporating the anti-spill ink filling port of the present invention. As the inkjet pen (201) moves along the assembly line from being assembled, it moves to the ink filling station. This station has an arm (501) or other such device that carries the ink through a conduit to the inkjet pen filling needle (510). FIG. 5 shows the arm as being at right angles to the filling needle (510). However, this is only one way of accomplishing an ink filling operation. Other embodiments use other ink filling arrangements such as having the ink filling conduit arm (501) and ink filling needle (510) be aligned with each other such that they come straight down from above the inkjet pen (201).

Figure 6:
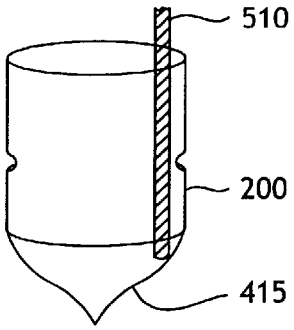
FIG. 6 shows a first phase of a needle insertion operation using the anti-spill filling port of the present invention.
Figure 7:
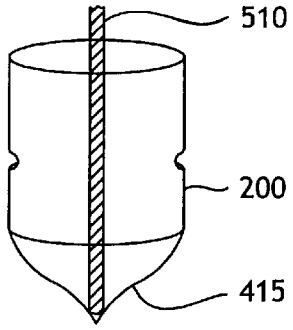
FIG. 7 shows a second phase of a needle insertion operation using the antispill filling port of the present invention.
Figure 8:
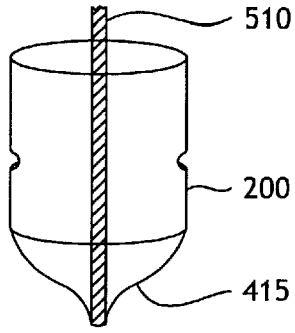
FIG. 8 shows a final phase of a needle insertion operation using the anti-spill filling port of the present invention.

FIGS. 6–8 illustrate the ink filling port (200) of the present invention as the ink filling needle (510) is inserted into the port (200) for filling the inkjet pen. FIG. 6 illustrates that as the needle (510) comes into the port (200), it may not be perfectly aligned with the apex (415) in the dome-shaped structure. The dome shape causes the needle (510) to follow the shape down to the apex (415).

FIG. 7 shows the needle (510) as it hits the apex (415) and is ready for insertion through the apex (415) into the inkjet pen interior in order to fill the inkjet pen. FIG. 8 shows that the needle (510) has penetrated the apex (415) of the dome-shaped structure. The multiple sections of the dome-shaped structure are separated along the grooved sides of the triangle-shaped sections.

In the preferred embodiment, the plastic triangle-shaped sections separate only enough to allow the circumference of the ink filling needle (510) into the inkjet pen. The memory effect of the plastic keeps a pressure on the needle (510) such that there is no gap between the needle (510) and the apex (415) where the needle (510) has penetrated. This prevents ink from spilling out of the ink filling port while it is being filled.

Figure 9:
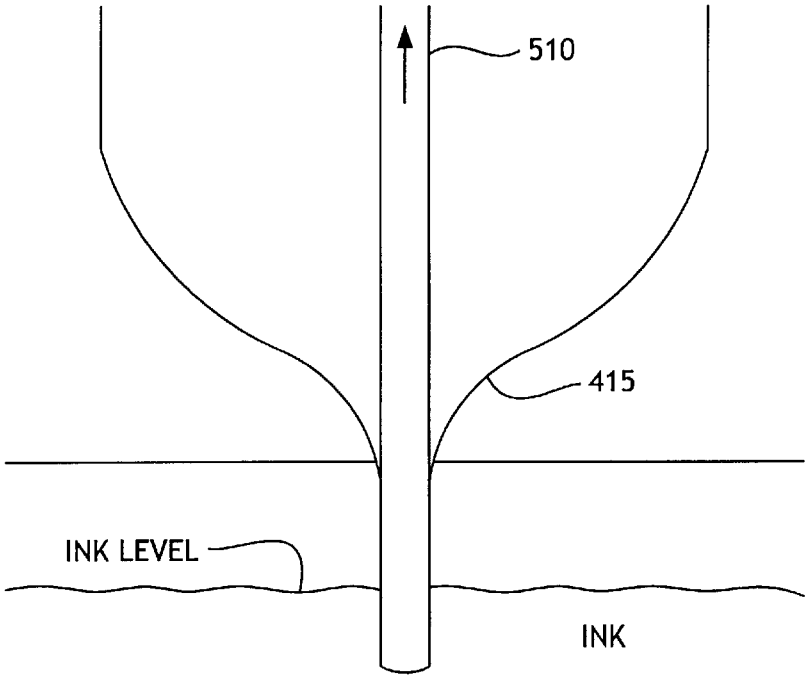
FIG. 9 shows the needle retraction operation in accordance with the anti-spill filling port of the present invention.

FIG. 9 illustrates that the inkjet pen has been filled up with ink to where the needle (510) has been inserted. As the ink filling needle (510) is being withdrawn, the memory effect of the plastic material comprising the filling port keeps pressure on the needle at the apex section (415). This pressure wipes the excess ink off the needle as it is being withdrawn from the filling port. Removing the excess ink from the needle eliminates the ink dripping from the needle onto the assembly line thus reducing the corrosive effects of the ink on the ink filling assembly line.

After the needle has been completely withdrawn from the anti-spill ink filling port of the present invention, the apex section and the triangle-shaped sections close back up and thereby keep the ink from spilling out of the inkjet pen as it moves away from the ink filling station. This reduces the corrosive effects of the ink on the assembly line equipment and, therefore, reduces the number of times the assembly line must be shut down to clean up spilled ink and replace corroded parts.

Figure 10:
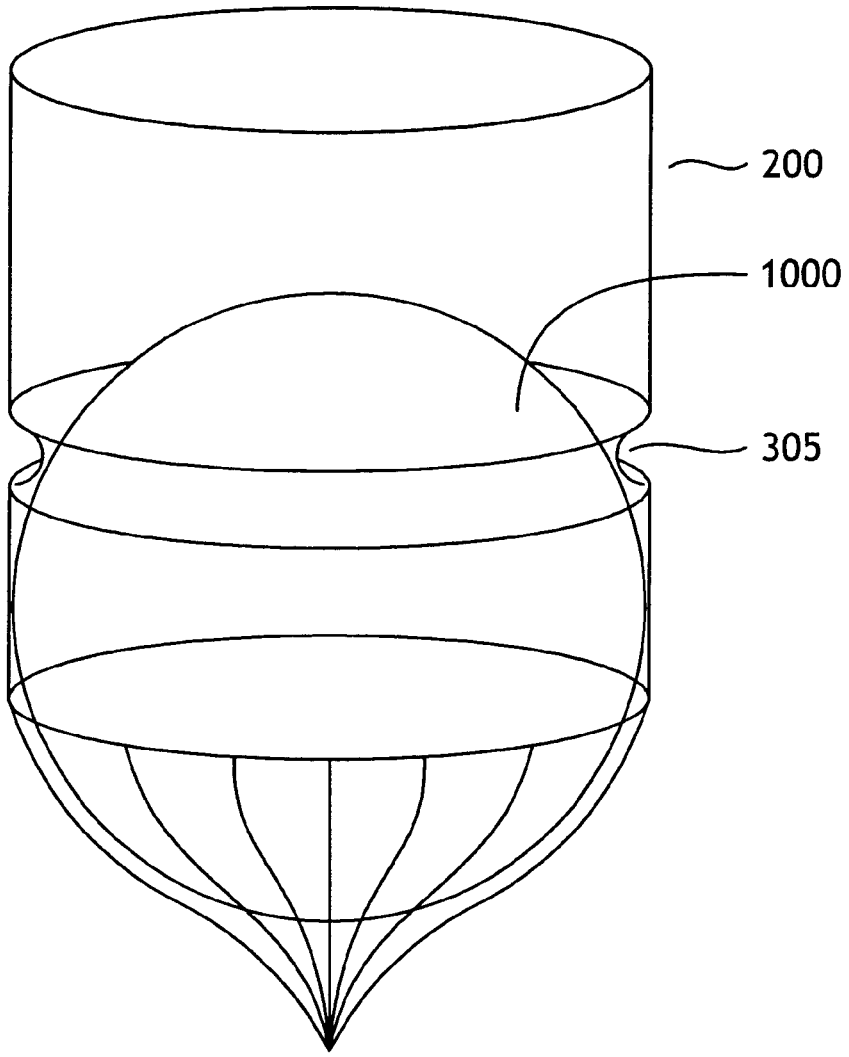
FIG. 10 shows a three dimensional view of the anti-spill filling port of the present invention incorporating a ball plug.

Before the inkjet pen can be packaged, it must be permanently sealed. FIG. 10 illustrates the preferred embodiment of sealing the anti-spill ink filling port of the present invention. After filling with ink, a stainless steel ball cork (1000) is inserted into the port (200). The ball (1000) has a slightly larger diameter than the port opening in order to achieve a compression fit. Pressure is applied to the ball (1000) to insert it into the port and past the ridge (305) running the circumference of the port (200). The ridge (305) reduces the area of the port such that once the ball (1000) is pushed beyond the ridge (305), it is held in place by pressure from the ridge. This seals the port and keeps the ink from spilling out no matter what the orientation of the inkjet pen. Additionally, a round plastic film patch is staked outside the port (200) to prevent any leakage due to thermal expansion and contraction of mating materials.

In the preferred embodiment, the plug for the ink filling port is the stainless steel ball cork. Alternate embodiments use other types of plugs with the same results. For example, a plastic plug of either a spherical shape or any other shape that can cap the ink filling port.

Figure 11:
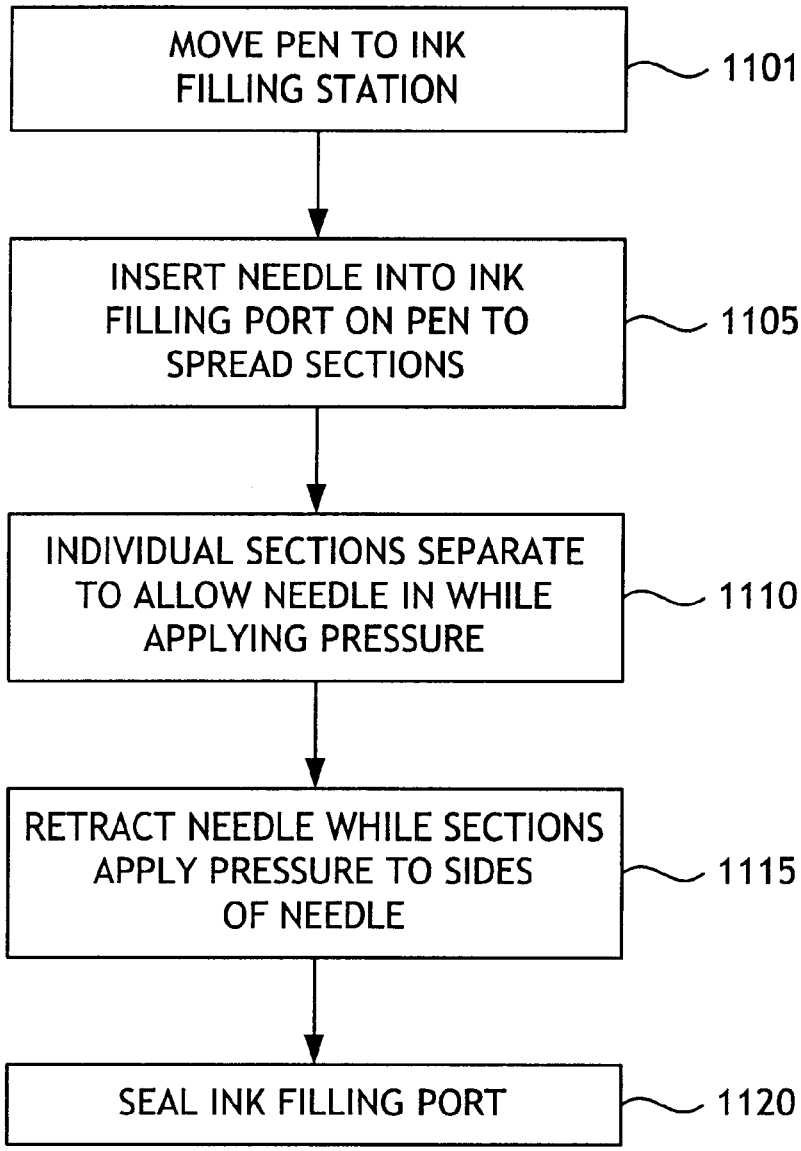
FIG. 11 shows a flowchart of the fluid filling operation of the present invention.
Figure 12:
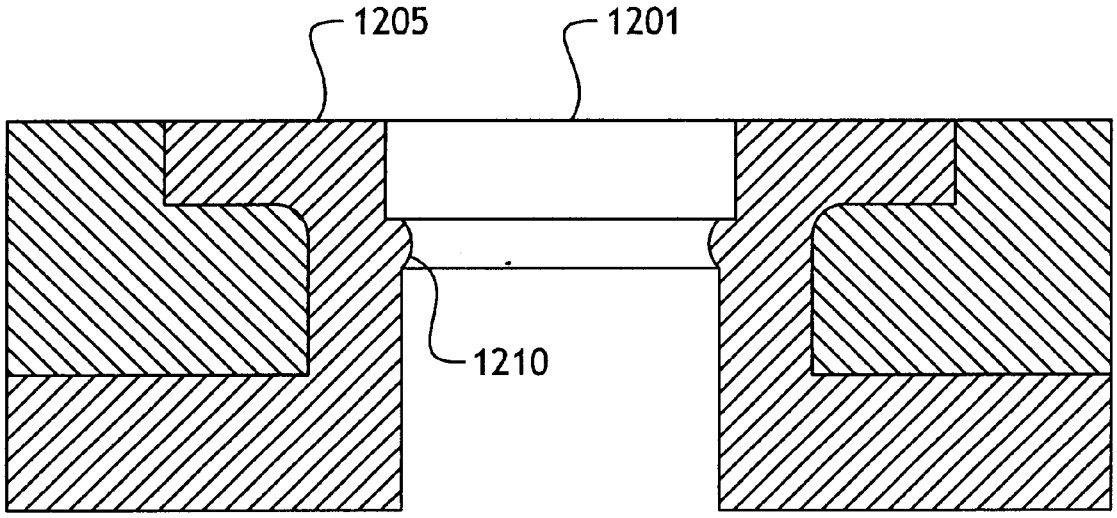
FIG. 12 shows a cross sectional view of a typical prior art ink filling port of the present invention.

FIG. 11 illustrates a flowchart of the ink filling process of the present invention. The process begins with the placement of the inkjet pen at the ink filling station (step 1101). The ink filling needle is inserted into the anti-spill ink filling port of the present invention (step 1105). The individual sections of the ink filling port separate so that the needle can be inserted into the pen through the apex of the ink filling port (step 1110).

After the inkjet pen has been filled, the ink filling needle is retracted while the individual sections of the ink filling port apply pressure to the needle and remove any ink clinging to the sides of the needle (step 1115). The individual sections then close back up as the inkjet pen moves to the capping station. At the capping station, a plug is inserted into the ink filling port to permanently close the port (step 1120). The ridge inside the ink filling port flexes to allow the plug into the port and then closes back around the plug in order to keep it firmly in place.

In summary, the anti-spill, ink filling port of the present invention enables an inkjet pen to be filled with ink while preventing the ink from spilling out of the pen as it moves from the ink filling station of assembly. The individual sections of the port also remove any ink on the sides of the ink filling needle as the needle is withdrawn by keeping pressure on the needle as it is removed from the inkjet pen.

Numerous modifications and variations of the present invention are possible in light of the above teachings. It is therefore to be understood that within the scope of the appended claims, the invention may be practiced otherwise than as specifically described herein.

What is claimed is:

1. An anti-spill, fluid filling port that accepts a fluid filling needle for transferring fluid into a fluid holding device, the fluid filling port comprising:

an upper section that maintains contact with the fluid holding device; and a sloping section, coupled to the upper section, the sloping section comprising:

a plurality of movable sections, each section being adjacent to two other sections and having a hinge side coupled to the upper section, the hinge side being the higher point of the sloping section; and an apex where the plurality of sections meet substantially simultaneously at the lowest point of the sloping section, wherein the upper section comprises a retaining device for holding in a plug against the sloping section.

2. The fluid filling port of claim 1 wherein the retaining device is a ridge on the inside of the upper section.

3. The fluid filling port of claim 2 wherein the sloping section is comprised of a dome shape that caps the bottom of the cylindrical upper section.

4. The fluid filling port of claim 1 wherein the upper section has a cylindrical shape.

5. The fluid filling port of claim 1 wherein the fluid holding device is an inkjet pen.

6. The fluid filling port of claim 1 wherein the fluid filling port is molded into an inner structure of the fluid holding device.

7. An anti-spill, ink filling port that accepts an ink filling needle and is molded into an inner liner of an ink dispensing device, the ink filling port comprising:

a cylindrical upper section; and a bottom, sloping section, coupled to the upper section, the bottom, sloping section comprising:

a plurality of movable sections, each section being adjacent between two other sections of the plurality of movable sections and having a wider, hinge side coupled to the upper section, the hinge side being the higher point of the bottom, sloping section; and an apex where the plurality of movable sections meet substantially simultaneously at the lowest point of the sloping section, wherein a retaining device holds a plug device against the inner surface of the bottom, sloping section such that the ink filling port is sealed.

8. The ink filling port of claim 7 wherein the bottom sloping section has a conical shape such that the widest portion of the conical shape is coupled to the upper section.

9. The ink filling port of claim 7 wherein the upper section is the same length as the thickness of inner liner.

10. The ink filling port of claim 7 wherein the upper section is longer than the thickness of the inner liner.

11. The ink filling port of claim 7 wherein the sloping section is comprised of a dome shape that caps the bottom of the cylindrical upper section.

12. The ink filling port of claim 7 wherein the upper section comprises said retaining device.

13. The ink filling port of claim 12 wherein the retaining device comprises a ridge on the inside of the upper section.

14. The ink filling port of claim 12 wherein the retaining device is sporadically located about the inner circumference of the upper section.

15. The ink filling port of claim 12 wherein the retaining device completely encircles the interior of the upper section.

* * * * *